US008835784B2

(12) United States Patent
Hirota

(10) Patent No.: US 8,835,784 B2
(45) Date of Patent: Sep. 16, 2014

(54) PUSH BUTTON STRUCTURE

(75) Inventor: Hideyuki Hirota, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 140 days.

(21) Appl. No.: 13/574,214

(22) PCT Filed: Jun. 25, 2010

(86) PCT No.: PCT/JP2010/004240

§ 371 (c)(1),
(2), (4) Date: Jul. 19, 2012

(87) PCT Pub. No.: WO2011/161732

PCT Pub. Date: Dec. 29, 2011

(65) Prior Publication Data

US 2012/0292167 A1 Nov. 22, 2012

(51) Int. Cl.
*H01H 13/70* (2006.01)
*H01H 21/24* (2006.01)

(52) U.S. Cl.
CPC ..... *H01H 21/24* (2013.01); *H01H 2221/016* (2013.01); *H01H 2221/044* (2013.01)
USPC ..... 200/343

(58) Field of Classification Search
USPC ..... 200/343, 520, 292, 296, 341, 5 R
See application file for complete search history.

(56) References Cited

U.S. PATENT DOCUMENTS

| | | | | |
|---|---|---|---|---|
| 6,121,563 | A * | 9/2000 | Hochgesang et al. | 200/343 |
| 2001/0003325 | A1* | 6/2001 | Nakagawa et al. | 200/343 |
| 2007/0227872 | A1* | 10/2007 | Hamada | 200/343 |

FOREIGN PATENT DOCUMENTS

| | | | |
|---|---|---|---|
| DE | 19538618 | C2 | 6/2003 |
| JP | 61-63738 | U | 4/1986 |
| JP | 62-67431 | U | 4/1987 |
| JP | 62-133333 | U | 8/1987 |
| JP | 62-149123 | U | 9/1987 |
| JP | 63-109427 | U | 7/1988 |
| JP | 3-126329 | U | 12/1991 |
| JP | 8-111137 | A | 4/1996 |
| JP | 2004-39324 | A | 2/2004 |

* cited by examiner

*Primary Examiner* — Edwin A. Leon
(74) *Attorney, Agent, or Firm* — Birch, Stewart, Kolasch & Birch, LLP

(57) ABSTRACT

A push button structure includes: a panel 1 in which an opening 2 for exposing a button 7 is provided; a button 7 having a leg of which one end side is supported by a rotational central section 5 of the panel 1 and of which the other end side has a leg 6 extending in an orthogonal direction to the panel 1, wherein the other end side is rotated about the rotational central section 5 when the button is pushed with exposed from the opening 2 of the panel 1; and a board 3 on which a switch 4 is mounted and which is attached at an angle to the panel 1 such that a direction C tangential to a rotational path of the leg 6 is substantially the same as a stroke direction D of the switch 4.

6 Claims, 5 Drawing Sheets

PUSH BUTTON STRUCTURE

TECHNICAL FIELD

The present invention relates to a push button structure provided on a panel of an in-vehicle apparatus and so on.

BACKGROUND ART

A conventional push button structure is a structure such that a push button is rotatably supported in an opening of a panel by a hinge section. When the button is pushed, the other end side thereof is rotated about the hinge section side, and a leg protrusively provided on the other side pushes a switch inside a panel. Since the panel to which the button is attached and a board on which the switch is mounted are disposed parallel to each other, the tip of the leg during rotation travels in a sliding manner on the switch. For this reason, when the button is depressed and recovered, friction is caused on the contact surfaces between the leg and the switch, which leads to a bad operational feeling of the button.

Thus, in a push button structure of Patent Document 1, for example, the contact faces between the tip of a leg of a button and a switch are provided with an inclined face so that frictional force upon recovery is reduced, thereby preventing an event such that the push button is not returned to an initial position.

PRIOR ART DOCUMENTS

Patent Documents

Patent Document 1: JP-A-08-111137 (JP-A-1996-111137)

SUMMARY OF THE INVENTION

Since the conventional push button structure is arranged as described above, the tip of the leg travels on the switch in a sliding manner to push the switch upon depression of the button, so that friction is caused, and/or the rotating button rubs the fringe of a panel opening, resulting in a bad operational feeling of the button, which poses a problem.

The present invention has been made to solve the above-mentioned problems, and an object of the invention is to provide a push button structure having an improved operational feeling of a button.

A push button structure of embodiments of the present invention includes: a panel in which an opening for exposing a button is provided; a button having a leg of which one end side is supported by the panel and of which the other end side has a leg extending in an orthogonal direction to the panel, wherein the other end side is rotated about the support unit when the button is pushed with exposed from the opening of the panel; and a board on which a switch is mounted, and which is attached at an angle to the panel such that a direction tangential to a rotational path of the leg is substantially the same as a stroke direction of the switch a plurality of buttons rotating about respective rotation centers, each button having a button body, a base section extending from a first end of the button body, and a leg extending from a second end opposite the first end; a panel having a plurality of openings for exposing the respective buttons, and a plurality of support sections each of which is provided at a position adjacent to the corresponding opening and supports the corresponding button; a plurality of switches to be pressed down by the respective buttons; and a circuit board in which the plurality of switches are mounted, wherein the circuit board is provided slanted with respect to the panel in such manner as to reduce or eliminate, at a contact point between one of the legs and a corresponding switch, an angle between a direction tangential to a rotational path of the one of the legs and a stroke direction of the corresponding switch compared to a case in which the circuit board is provided parallel with respect to the panel, and wherein the leg of the button located in the shorter position between the panel and the circuit board is formed shorter than the leg of the button located in the longer position between the panel and the circuit board.

According to an aspect of embodiments of the invention, when the board and the button are attached at an angle to the panel, the direction tangential to the rotational path of the tip of the leg of the button is substantially the same as the stroke direction of the switch; thus, it becomes possible to restrain the tip of the leg from sliding on the switch, thereby providing the push button structure with an improved operational feeling thereof.

BEST MODE FOR CARRYING OUT THE INVENTION

In the following, in order to explain the present invention in more detail, embodiments of the invention will be described with reference to the accompanying drawings.

First Embodiment

Figure 1:
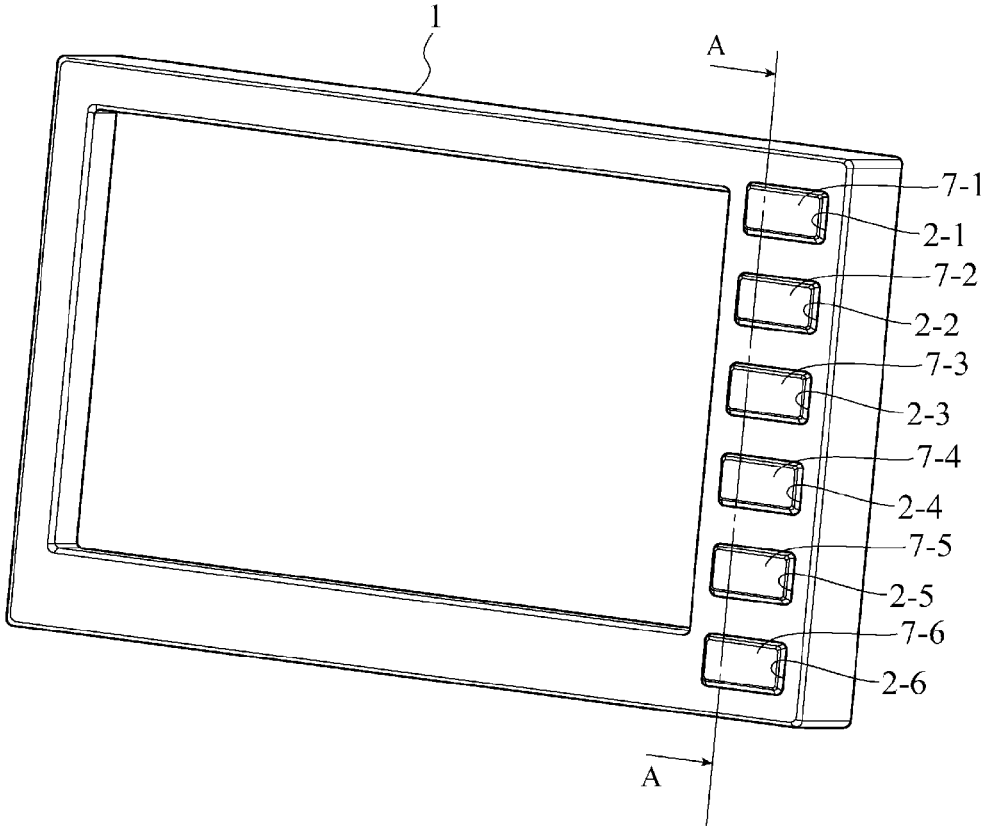
FIG. 1 is an exploded perspective view showing an arrangement of a panel of an in-vehicle apparatus to which a push button structure of a first embodiment in the present invention is applied.
Figure 2:
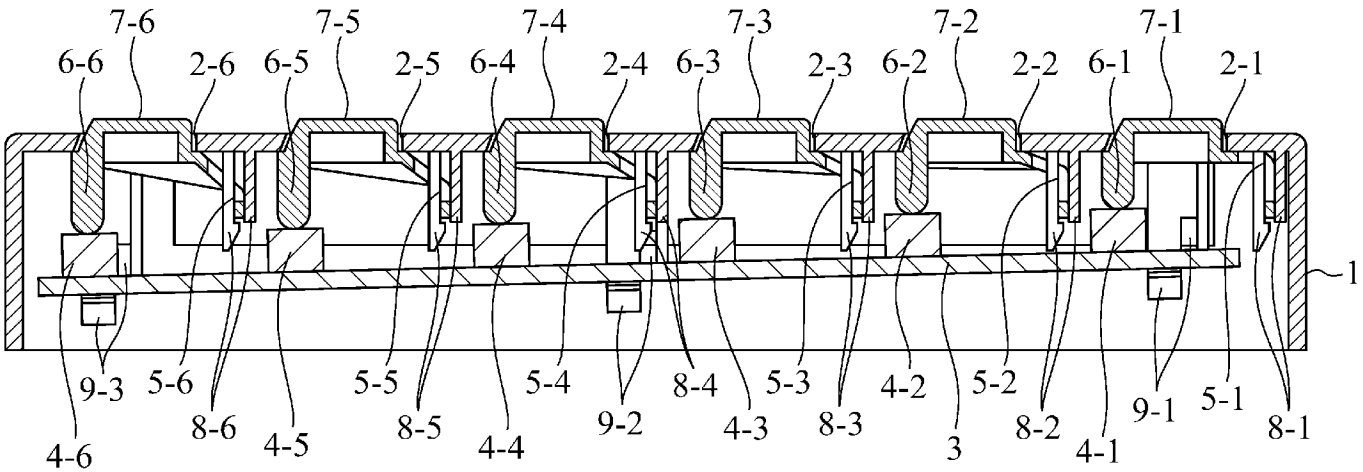
FIG. 2 is a sectional view of the panel taken along a line A-A shown in FIG. 1, showing one example of a board mounting structure.

A constructional example to which a push button structure of a first embodiment in the invention is applied to a panel 1 on the front of an in-vehicle apparatus will be described. As shown in FIG. 1 and FIG. 2, a push button structure includes: the panel 1 in which openings 2-1 to 2-6 for exposing a button are provided; a board 3 attached at an angle to the panel 1; switches 4-1 to 4-6 mounted on a face of the board 3 opposite to the panel 1; and buttons 7-1 to 7-6 for pushing the switches 4-1 to 4-6 with legs 6-1 to 6-6 on the other end side thereof, such that the buttons are rotated about rotational central sections 5-1 to 5-6 on one end side thereof, when the buttons are pushed toward the side of the board 3 with exposed from the openings 2-1 to 2-6 of the panel 1, respectively.

Hereinafter, when parts common to the openings 2-1 to 2-6 are explained, the openings are simply referred to as an "opening 2" without distinction. Similarly, the switches 4-1 to 4-6 are referred to as a "switch 4," the rotational central sections 5-1 to 5-6 are referred to as a "rotational central section 5," the legs 6-1 to 6-6 are referred to as a " leg 6," and the buttons 7-1 to 7-6 are referred to as a "button 7."

Figure 3:
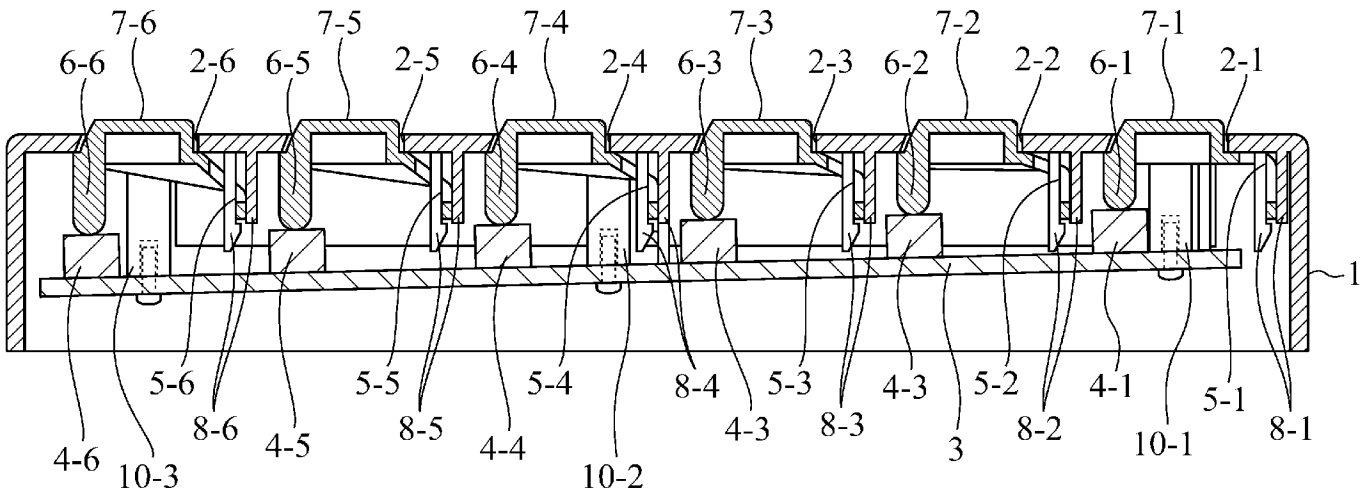
FIG. 3 is a sectional view of the panel taken along the line A-A shown in FIG. 1, showing another example of the board mounting structure.

The board 3 is disposed in a condition inclined to the panel 1 and the button 7. For an attaching structure of the board 3 to the panel 1, as shown in FIG. 2, the board 3 is held to be pinched in a front-to-back direction by pawl sections 9-1 to 9-3, or as shown in FIG. 3, spacers 10-1 to 10-3 are sandwiched between the panel 1 and the board 3, and then the board 3 and the spacers 10-1 to 10-3 are fixed to each other by screws. Though the switch 4 is mounted on the board 3, the board 3 is inclined, and thereby the switch 4 is also inclined.

Figure 4:
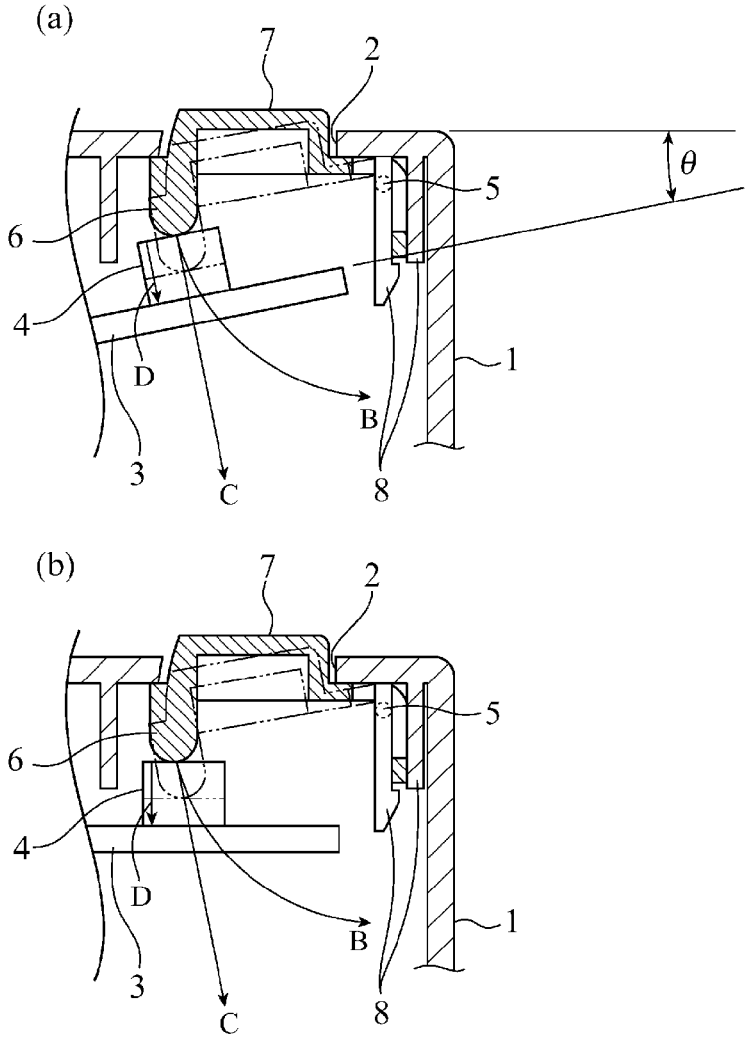
FIG. 4 is an enlarged sectional view of one of the push button structures shown in FIG. 2.

FIG. 4(*a*) shows an enlarged view of a push button structure. Assuming that the surface of a button 7 exposed from an opening 2 is defined as the front, one end side of the bottom fringe facing toward the board 3 is rotatably supported by a supporting section 8 formed on the back of the panel 1. Parts common to the supporting sections 8-1 to 8-6 are also simply referred to as the "supporting section 8" when explained. In an illustrative example, it is configured that a fringe on one end side of the button 7 is bent, the tip of the bent fringe is sandwiched by the supporting section 8, and also the bent section is supported by the rotational central section 5 provided protrusively on the supporting section 8. Upon depression of the button 7, the other end side thereof is rotated about the support unit on the one end side, that is, the rotational central section 5, and upon recovery of the button, the other end side is recovered by the elastic force of the bent section to the position before the depression. A leg 6 extending to the switch 4 on the side of the board 3 is formed on the other end side of the button 7. The tip of the leg 6 is formed in a sphere to thus decrease a contact area with the switch 4.

As shown in FIG. 4(*a*), when the button 7 is pushed from a condition exposed from the opening 2 of the panel 1 toward the board 3, the leg 6 rotates about the rotational central section 5 to push the switch 4. At this time, provided that an inclination angle θ of the board 3 to the panel 1 is an angle such that a direction C tangential to a rotational path B of the tip of the leg 6 can be possibly parallel to a stroke direction D of the switch 4, the leg 6 can be restrained from sliding on the switch 4. Therefore, friction thereof can be suppressed, and the operational feeling of the button 7 is enhanced.

On the other hand, as shown in FIG. 4(*b*), when the board 3 is attached parallel to the panel 1, the tangential direction C is not parallel to the stroke direction D; thus, upon depression of the button 7, the leg 6 travels as slid on the surface of the switch 4. Therefore, the amount of slippage of the leg 6 of the button 7 is larger as compared with the case of FIG. 4(*a*), and a feeling of slippage is transmitted to the button 7, resulting in a bad operational feeling thereof.

Figure 5:
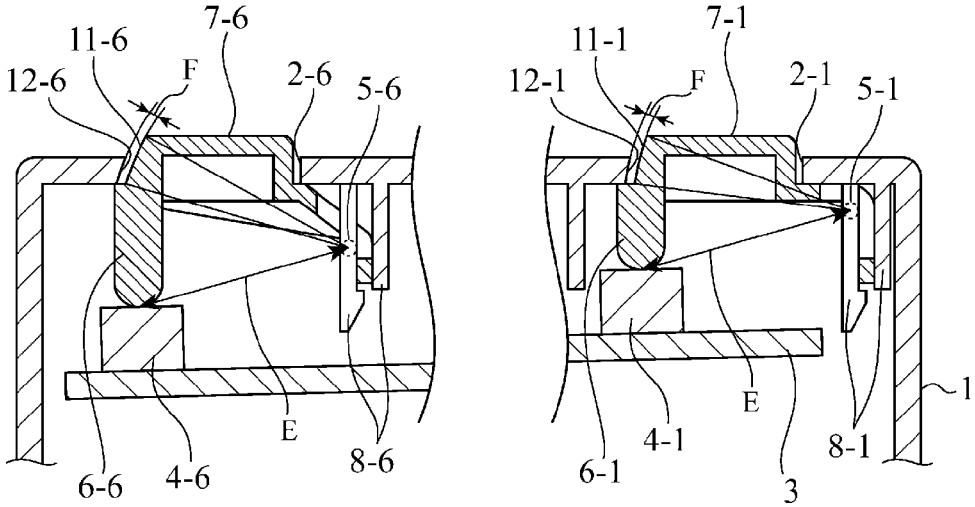
FIG. 5 is an enlarged sectional view of the push button structures located at both ends of the panel shown in FIG. 2.

As shown in FIG. 2 or FIG. 3, when a plurality of buttons 7-1 to 7-6 are disposed in juxtaposition, the lengths of the legs 6-1 to 6-6 of the buttons 7-1 to 7-6 are respectively adjusted to those according to the distances from the panel 1 to the board 3. Specifically, the leg 6-1 of the button 7-1 located in the shortest position between the panel 1 and the board 3 is most shortened, and the respective legs 6-2 to 6-5 of the buttons 7-2 to 7-5 are elongated in ascending order, and the leg 6-6 of the button 7-6 located in the longest position between the panel 1 and the board 3 is most elongated. FIG. 5 shows an enlarged view of the buttons 7-1 and 7-6 shown in FIG. 2. As mentioned above, the lengths of the legs 6-1 to 6-6 are adjusted according to the distance between the panel 1 and the board 3, and thereby the tips thereof are kept in contact with the switches 4-1 to 4-6, respectively.

Further, the rotational central sections 5-1 to 5-6 are disposed in positions where the distance between the rotational central section 5 and the tip of the leg 6 is the same for each of the buttons 7-1 to 7-6. As shown in an enlarged view of FIG. 5, the positions of the rotational central sections 5-1 and 5-6 are determined such that the distance E between the rotational central section 5-1 of the button 7-1 and the tip of the leg 6-1 is equal to the distance E between the rotational central section 5-6 of the button 7-6 and the tip of the leg 6-6, and are supported by the supporting sections 8-1 and 8-6 such that the determined positions serve as centers of rotation. As illustrations thereof are omitted in FIG. 5, similarly with the buttons 7-2 to 7-5, the positions of the rotational central sections 5-2 to 5-5 are determined to be supported by the supporting sections 8-2 to 8-8. In this manner, it is contemplated that the operational feelings of the buttons 7-1 to 7-6 are unified.

Further, as shown in the enlarged view of FIG. 5, a sidewall 11-1 rotating toward the side of the board 3 about the rotational central section 5-1 of the button 7-1 and a fringe portion 12-1 of the opening 2 of the panel 1 that faces the sidewall 11-1 are formed as an arc surface about the rotational central section 5-1 of the button 7-1. In such a way, a clearance F between the button 7-1 and the opening 2-1 is kept constant even upon depression of the button 7-1, the friction between the button 7-1 and the panel 1 on the depression can be prevented, and also recovery failure thereof and so on can be restrained. Similarly to the buttons 7-2 to 7-6, the sidewall and the fringe portion each are formed as an arc surface.

Figure 6:
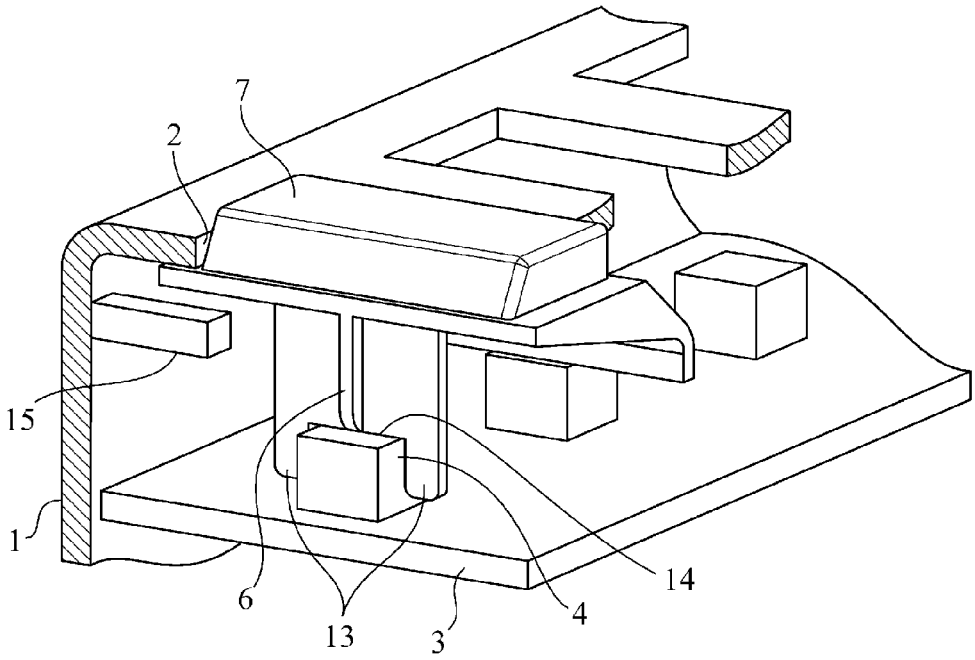
FIG. 6 is an enlarged perspective view of one of the push button structures.

Moreover, a stopper section 13 for preventing the button 7 from being excessively depressed is provided in a direction projecting from the tip of the leg 6. FIG. 6 is an enlarged perspective view of the push button structure. As shown in FIG. 6, the portion of the tip of the leg 6 to abut against the switch 4 is defined as a switch pushing section 14, and both sides of the switch pushing section 14 are protruded to form a stopper section 13. When the switch pushing section 14 pushes the switch 4, the stopper section 13 abuts against the board 3 with straddling the switch 4, thereby suppressing the load that can break the switch 4. Furthermore, the aligned arrangement of the switch pushing section 14 and the stopper section 13 facilitates the dimensional control of the stopper section 13 in a direction of height, which enables to prevent the stopper section 13 from abutting against the board 3 before the switch pushing section 14 pushes the switch 4 completely.

On the other hand, conventionally, as similarly shown in FIG. 6, a stopper section 15 is provided by protruding a portion of the back of the panel 1, or another stopper section 15 is provided by protruding a portion of the spacer 10-1 shown in FIG. 3. However, since the stopper sections 15 are not arranged to be provided directly on the button 7 unlike the stopper section 13, it is adversely influenced by variations in size and in assembly of the button 7, the panel 1 (or, the spacer 10-1), and the board 3, in addition to variations in size of the stopper section 15 itself. Therefore, the stopper section 15 can abut against one fringe of the button 7 to obstruct the depression thereof before the tip of the leg 6 of the button 7 pushes the switch 4 thoroughly.

As described above, according to the first embodiment, the pushbutton structure is configured to include: the panel 1 in which the opening 2 for exposing the button 7 is provided; the button 7 of which the one end side is supported by the rotational central section 5 of the panel 1, and of which the other end side has the leg 6 extending in an orthogonal direction to the panel 1, such that the other end side rotates about the rotational central section 5 thereof when the button is pushed with exposed from the opening 2 of the panel 1; and the board 3 on which the switch 4 is mounted, and which is attached at an angle to the panel 1, such that the direction C tangential to the rotational path of the leg 6 is substantially the same as the stroke direction D of the switch 4. For this reason, the tip of the leg 6 of the button 7 can be restrained from sliding on the switch 4, and the push button structure with the improved operational feeling can be provided.

Further, according to the first embodiment, it is configured that when a plurality of buttons 7 are arranged, the length of the leg 6 of each of the buttons 7 is determined according to the distance between the panel 1 and the board 3, such that the leg 6 of the button 7 located in the shorter position between the panel 1 and the board 3 is shortened, and that the leg 6 of the button 7 located in the longer position between the panel 1 and the board 3 is elongated, and also the rotational central section 5 is disposed in a position where the distance between the rotational central section 5 and the tip of the leg 6 is the same for each of the buttons 7. For this reason, the operational feelings of the plurality of buttons 7 can be unified.

Moreover, according to the first embodiment, the sidewall 11 of the button 7 on the side thereof where the leg 6 is provided and the fringe portion 12 of the opening 2 of the panel 1 that faces the sidewall 11 are formed as an arc surface about the rotational central section 5 of the button 7, so that no rotating button 7 rubs the panel 1, thereby improving the operational feeling thereof.

Further, according to the first embodiment, it is configured that the leg 6 of the button 7 has the stopper section 13 having a shape that projects from the tip of the leg 6 and that abuts against the board 3 with straddling the switch 4, when the tip of the leg 6 pushes the switch 4. For this reason, no stopper section 13 interferes with the rotation of the button 7 before the switch pushing section 14 of the tip of the leg 6 depresses the switch 4, thereby improving the operational feeling thereof.

Furthermore, according to the first embodiment, when the tip of the leg 6 of the button 7 is shaped in a sphere, the contact area with the switch 4 is decreased to thus suppress the friction feeling upon the depression, thereby improving the operational feeling thereof.

INDUSTRIAL APPLICABILITY

As described above, since the push button structure of the present invention improves the operational feeling of the button, it is suitable for use in the push button structure provided in the casing of the electronic apparatus of the in-vehicle apparatus and so on.

The invention claimed is:

1. A push button structure comprising:

a plurality of buttons rotating about respective rotation centers, each button having a button body, a base section extending from a first end of the button body, and a leg extending from a second end opposite the first end;

a panel having a plurality of openings for exposing the respective buttons, and a plurality of support sections each of which is provided at a position adjacent to the corresponding opening and supports the corresponding button;

a plurality of switches to be pressed down by the respective buttons; and a circuit board in which the plurality of switches are mounted, wherein the circuit board is provided slanted with respect to the panel in such manner as to reduce or eliminate, at a contact point between one of the legs and a corresponding switch, an angle between a direction tangential to a rotational path of the one of the legs and a stroke direction of the corresponding switch compared to a case in which the circuit board is provided parallel with respect to the panel, and wherein the leg of the button located in the shorter position between the panel and the circuit board is formed shorter than the leg of the button located in the longer position between the panel and the circuit board.

2. The push button structure according to claim 1, wherein the distance between the rotation center and the tip of the leg is the same for each of the buttons.

3. The push button structure according to claim 1, wherein each sidewall of the plurality of buttons provided at the second end and each fringe portion of the openings facing the corresponding sidewall are formed as an arc surface with respect to the corresponding rotation center.

4. The push button structure according to claim 1, wherein at least one of the buttons further has a stopper section longer than the leg concerned, the stopper section being for restricting over-depression of the switch concerned.

5. The push button structure according to claim 1, wherein the tip of the leg of the button is semicircular in a cross section along the first to second end direction.

6. A push button structure comprising:

a plurality of buttons rotating about respective rotation centers, each button having a button body, a base section extending from a first end of the button body, and a leg extending from a second end opposite the first end;

a panel having a plurality of openings for exposing the respective buttons, and a plurality of support sections each of which is provided at a position adjacent to the corresponding opening and supports the corresponding button;

a plurality of switches to be pressed down by the respective buttons; and a circuit board in which the plurality of switches are mounted, wherein the circuit board is provided slanted with respect to the panel so as to reduce or eliminate, at a contact point between one of the legs and a corresponding switch, an angle between a direction tangential to a rotational path of the one of the legs and a stroke direction of the corresponding switch compared to a case in which the circuit board is provided parallel with respect to the panel, and wherein the tip of the leg of the button is semicircular in a cross section along the first to second end direction.

* * * * *